United States Patent [19]

Hubbard

[11] 4,171,744

[45] Oct. 23, 1979

[54] DOCUMENT CLASSIFIER

[75] Inventor: David W. Hubbard, Stamford, Conn.

[73] Assignee: Pitney-Bowes, Inc., Stamford, Conn.

[21] Appl. No.: 797,787

[22] Filed: May 17, 1977

[51] Int. Cl.[2] ..... B07C 5/04

[52] U.S. Cl. ..... 209/586; 209/900; 250/560; 356/398

[58] Field of Search ..... 209/73, 74 R, 82, 111.5, 209/111.7 R, DIG. 1, 586, 900; 250/560, 561; 356/159, 160, 167

[56] References Cited

U.S. PATENT DOCUMENTS

| | | | |
|---|---|---|---|
| 3,038,607 | 6/1962 | Eckert | 209/82 X |
| 3,215,271 | 11/1965 | Cecchini | 209/111.7 R |
| 3,856,412 | 12/1974 | Zanoni | 250/560 X |
| 3,943,361 | 3/1976 | Miller | 250/560 X |
| 4,110,048 | 8/1978 | Akutsu et al. | 356/200 |

*Primary Examiner*—Joseph J. Rolla
*Attorney, Agent, or Firm*—Peter Vrahotes; William D. Soltow, Jr.; Albert W. Scribner

[57] ABSTRACT

This invention relates to the classification of a stream of documents, such as mixed mail pieces, into size and orientation of categories for subsequent processing. The apparatus includes a laser beam which scans a conveying belt upon which the documents are placed. Appropriate circuitry is provided so that a determination may be made as to the length and width of the document being conveyed across the belt. Downstream from the belt is a segregation system in which the various sizes of documents are segregated according to size in response to the determination of the circuitry.

6 Claims, 9 Drawing Figures b
a

DOCUMENT CLASSIFIER

BACKGROUND OF THE INVENTION

In the present processing of mail pieces, such as flats, envelopes and packages, facer canceller machines are designed to take specific size items. Automatic facer cancellers are available for cancelling letters and facer canceller tables are used to cancel flats manually. A letter generally has a width of 3 to 6.12 inches and a length of 4¼ to 11.5 inches whereas a flat will generally have a width between 6.12 and 15 inches and a length between 11.5 and 15 inches. Presently the segregation of mail pieces is carried out by hand, the operator placing the letters into a facer canceller and flats onto a facer canceller table. It obviously would be desirable to be able to provide a system that would be able to segregate letters and flats as well as other sized documents.

SUMMARY OF THE INVENTION

Mail pieces are placed upon the surface of a continuous belt to be conveyed from one end to the other end thereof. A laser beam laterally scans the belt so that the size of a mail piece upon the belt may be determined in response to the speed of the scanning beam and the speed with which the mail is conveyed by the belt. A plurality of receptacles are located downstream from the belt and a conveying means is provided to transport the mail pieces from the belt to an appropriate receptacle depending upon the results of the scan.

BRIEF DESCRIPTION OF THE DRAWING

Referring now to FIGS. 1-3, an apparatus is shown generally at 10 for scanning and determining the size of documents such as letters and flats. The apparatus includes a continuous longitudinally extending belt 12 that is trained about a pair of opposed rollers 14, 16, one of the rollers being a drive roller. Upon the belt 12 a plurality of documents 18 may be deposited in any acceptable manner. The rollers 14 and 16 are inclined at a slight angle as may be seen in FIG. 2 and the belt 12 is provided with a guide rail 22 adjacent the lower edge thereof, the guide rail having a photodetector 20 located thereon. With this construction a document 18 would be placed in contact with the guide rail 22 through the combination of gravity and motion of the belt 12. Upstream from the belt 12 is a feeding device 24. Such a feeding device 24 would be capable of sorting mail so that it may be deposited individually upon the belt 12. Such devices are well known, as for example, the type described in U.S. Pat. Nos. 3,061,067 and 3,236,355. Each of these patents shows a means for edging and streaming pieces of mail. Additionally, means may be provided in such devices for withholding the occasional document having too great a thickness.

Figure 1:
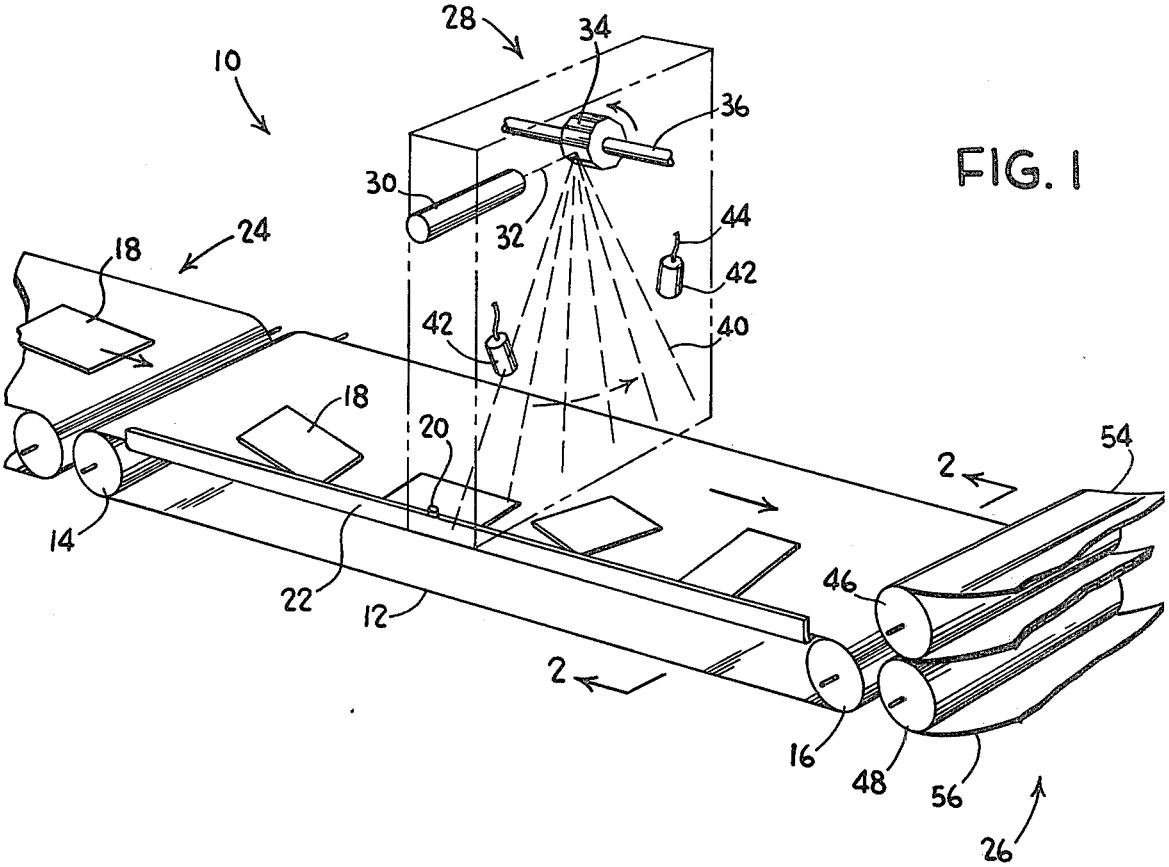
FIG. 1 is a perspective view of a scanning apparatus for determining the size of mail pieces that is part of a document classifying system incorporating the features of this invention.
Figure 2:
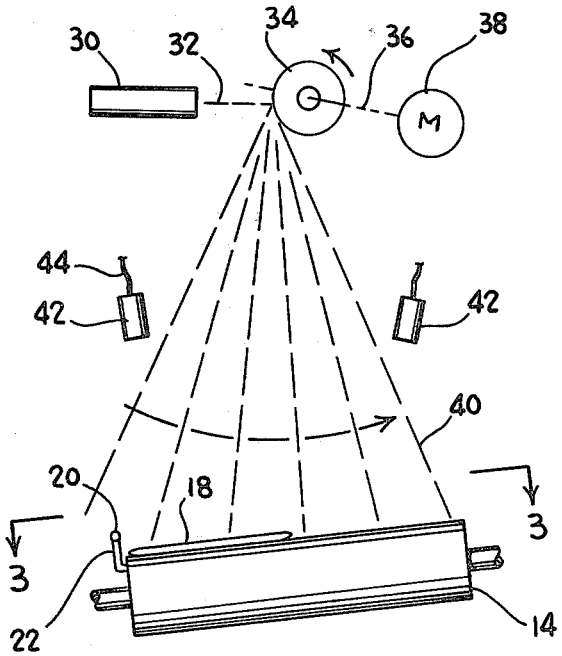
FIG. 2 is a cross-sectional view of the apparatus of FIG. 1 taken along the lines 2—2.

Disposed above the belt 12 intermediate the rollers 14, 16 is a scanning system 28. The scanning system 28 includes a laser 30 which directs a laser beam 32 to a multi-faceted mirror 34 that is mounted on a shaft 36 which extends generally longitudinally relative to the belt 12. The shaft 36 is engaged by a synchronous motor 38 to provide rotational drive to the mirror 34. As the mirror 34 is rotated, a plurality of scan beams 40 are directed across the belt 12. A pair of photodetectors 42 are located above the belt and are in a position to sense light that may be reflected from an object on the belt 12. Each of the photodetectors 42 has an electrical lead 44 extending therefrom. The belt 12 should be a dark, absorbent color so as to contrast with the documents 18 that will generally have light reflecting surfaces. In this way, when light strikes the belt 12 surface, no light will be reflected to the photodetectors 42; whereas, when a scan beam 40 engages a document 18 light will be reflected to the photodetectors 42. The scan 40 will also be detected by the photodetector 20 thereby indicating the start of a scan.

Figure 4:
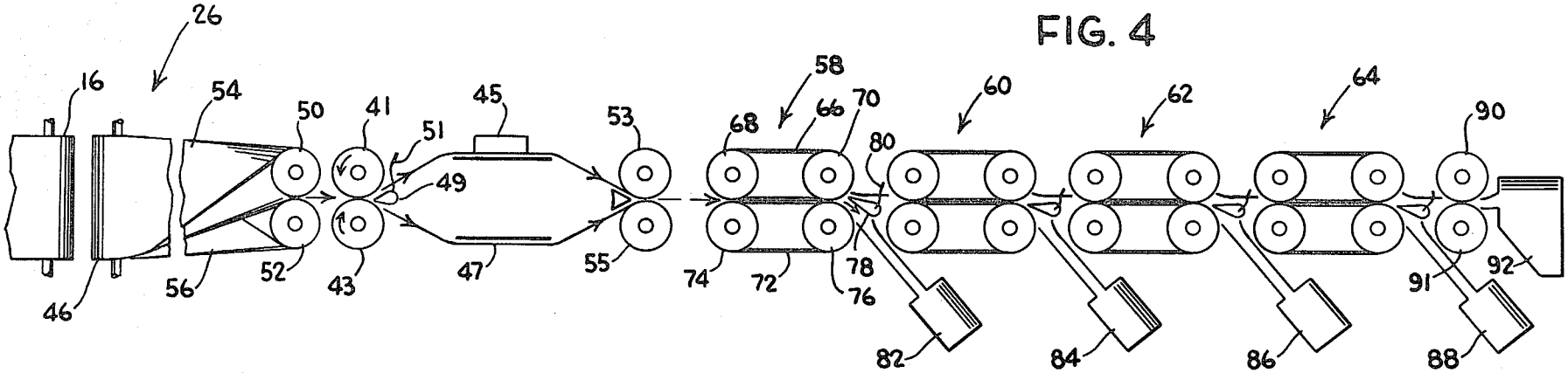
FIG. 4 is a top plan view of a segregating apparatus located downstream from the apparatus shown in FIG. 1 and which forms part of the document classifying system, portions thereof being shown schematically.

Referring now to FIGS. 1 and 4, downstream from the roller 16 is the discharge system 26 which includes a first pair of rollers 46 and 48 which are generally horizontally aligned to receive documents 18 discharged from the belt 12 and a second pair of rollers 50 and 52 which are vertically aligned. Trained about the rollers 46, 50 is a first belt 54 and trained about the rollers 48, 52 is a second belt 56. It will be appreciated by one skilled in the art that this is a well-known combination for changing the direction of travel of a document from a horizontal posture to a vertical position.

Figure 3:
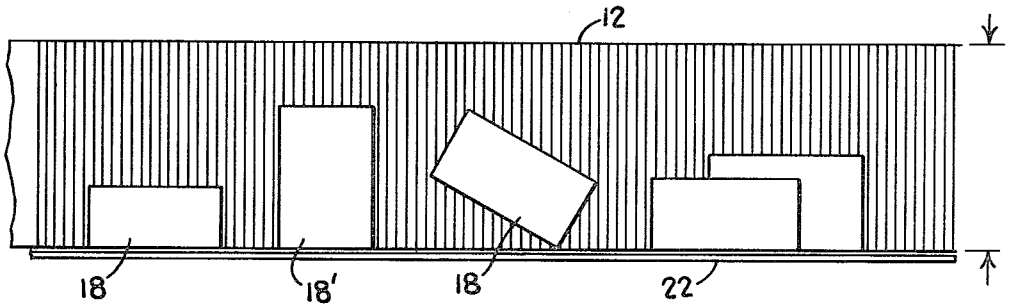
FIG. 3 is a plane view of a portion of the apparatus shown in FIG. 2 taken along the lines 3—3.

Downstream from the belts 54, 56 are a pair of rollers 41, 43 and a pair of document conveyors 45, 47, there being a gate 49 to direct a document either to the upper conveyor 45 or lower conveyor 47. The gate 49 may be actuated by a solenoid (not shown) and has a lead 51 extending therefrom. The upper conveyor 45 is a mechanism that will rotate a document 18 through a 90 degree angle while conveying the same, thereby orienting misaligned documents such as 18' in FIG. 3 so that the length of a document is aligned horizontally. Such rotating mechanisms are well known and will not be described in detail. An example of such a mechanism may be found on the Mark II facer-canceller marketed by Pitney-Bowes, Inc. the instant assignee. Those documents which are properly aligned will be directed to the lower conveyor 47, it being understood that both the upper and lower conveyors 45, 47 will convey a document at the same speed. Adjacent to the conveyors 45, 47 is another pair of opposed rollers 53, 55 which are located to receive documents therefrom and convey them to a plurality of belt assemblies 58, 60, 62 and 64.

Each belt assembly 58, 60, 62 and 64 includes a first belt 66 trained about an upstream roller 68 and downstream roller 70 and a second belt 72 adjacent to the first belt and trained about rollers 74 and 76. Downstream from the first and second belts 66, 72 is a gate 78 which may be actuated by a solenoid (not shown) and a lead 80 extends from each gate 78. Each belt assembly has a receptacle 82, 84, 86 and 88 associated therewith, the receptacle may be either a tray or a hopper. Downstream from the gate assembly 64 are a pair of rollers 90 and 91 and a receptacle 92. It will be appreciated that the belt 12; the conveyors 45, 47; the belt assemblies 58, 60, 62, and 64; and rollers 41, 43, 53, 55, 90 and 91 are synchronized so as to convey the documents 18 at a uniform speed throughout the entire length of the system shown in FIGS. 1 and 4.

Figure 5:
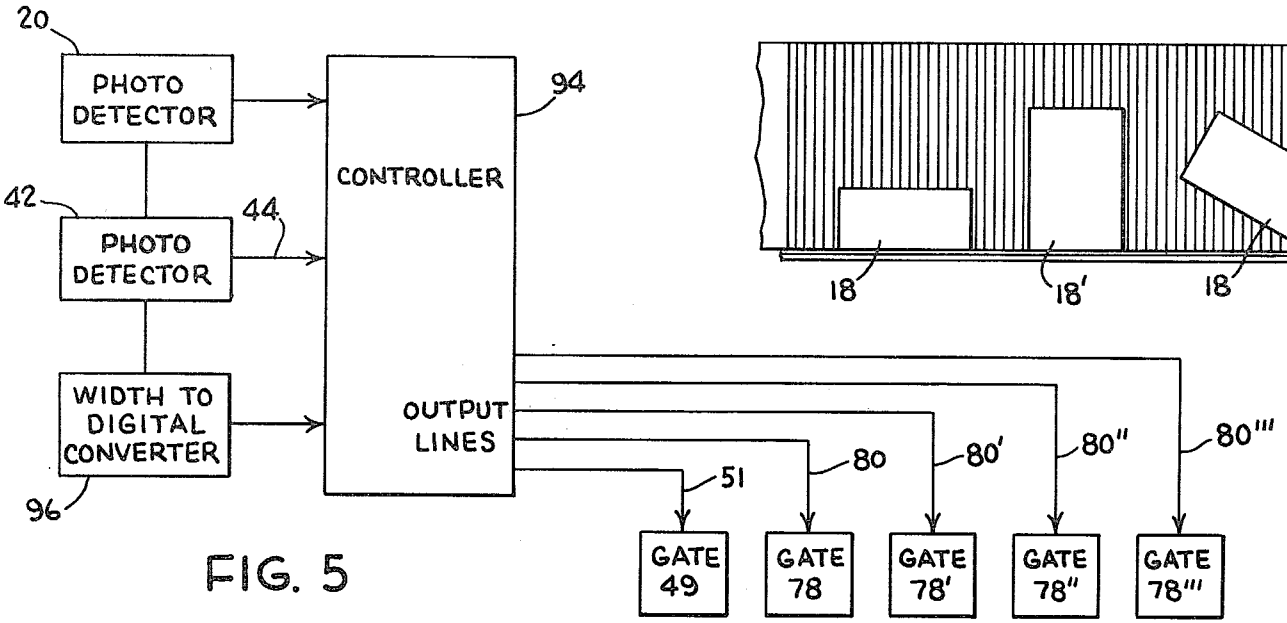
FIG. 5 is a block diagram of document sorting control circuitry for the present invention.
Figure 6:
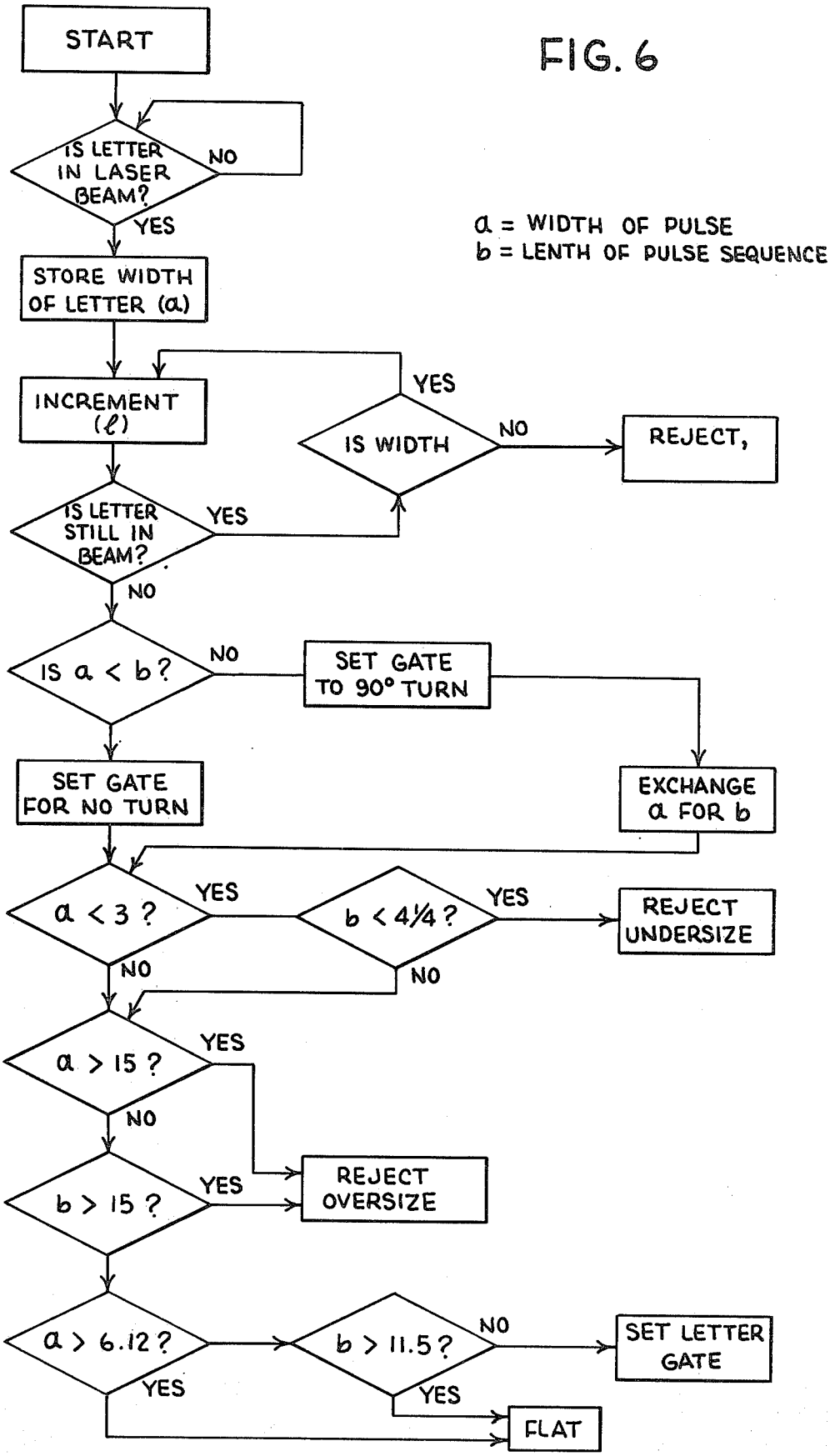
FIG. 6 is a block diagram of a program for the controller shown in FIG. 5.

Referring to FIG. 5, a block diagram is shown of the logic circuity involved in carrying out the invention. Each of the leads 44 from the photodetectors 42 is electrically connected to a decision logic controller 94 and a width digital converter 96. The controller 94 is in turn in electrical connection with the width to digital converter 96. The photodetector 20 also is in electrical connection with the controller. The logic which may be programmed into the controller 94 is shown in FIG. 6 to which reference may be had during the description of operation. The logic controller 94 may be a single chip microprocessor such as an INTEL 8048 and the width to digital converter 96 may be implemented by using the interval timer/event counter present within the 8048 chip as disclosed in MCS-48 Microcomputer Users Manual, INTEL Corp., page 1-1 (1976).

Figures 7, 8, 9:
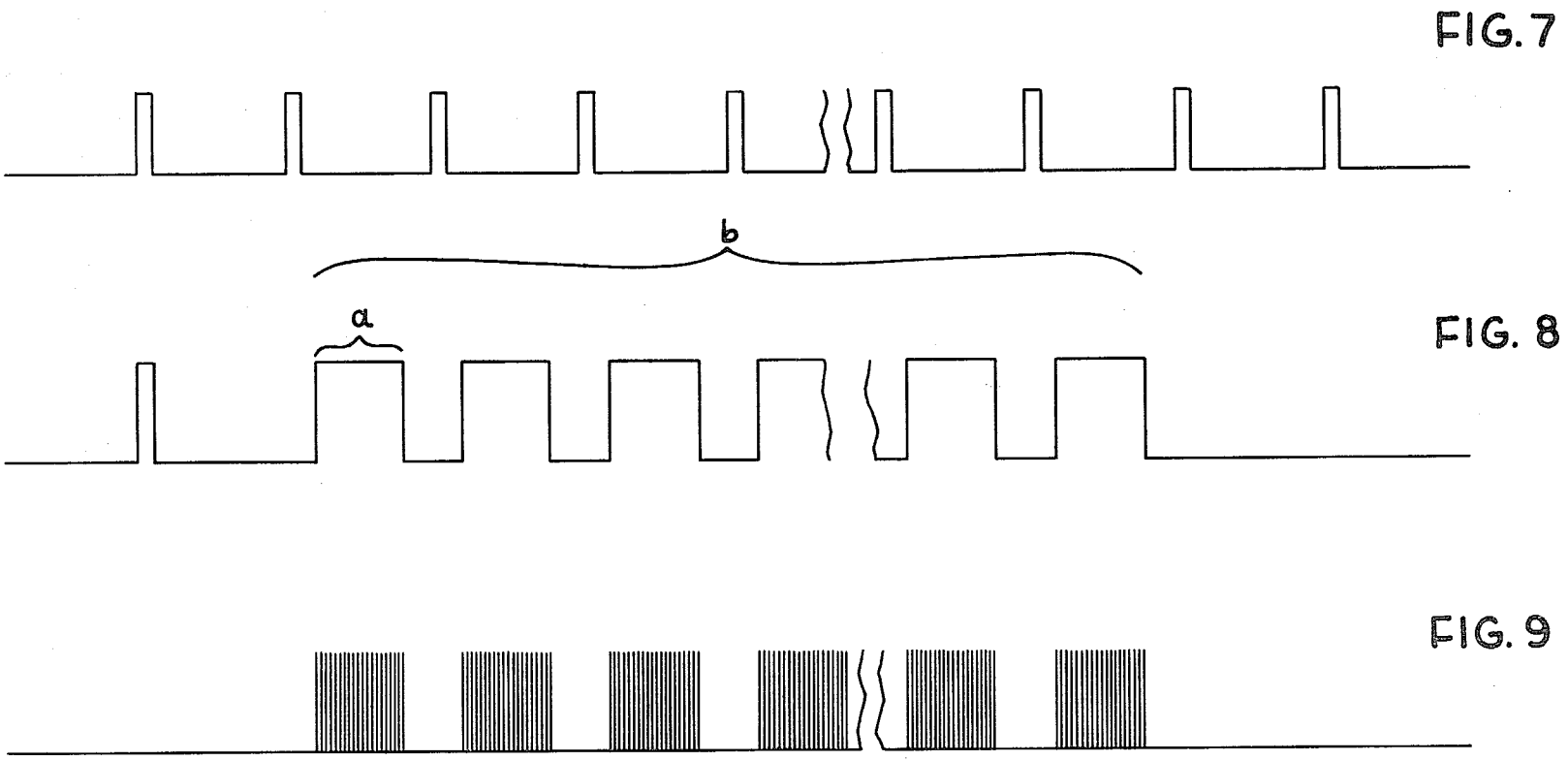
FIG. 7 is a diagram showing the timing pulses produced in conjunction with the apparatus shown in FIGS. 1 and 5.
FIG. 8 is a representation of a scan pattern produced when a document is detected.
FIG. 9 is a representation of the scan pattern of FIG. 8 digitalized.

In operation, the speed of the belt 12 and of the motor 38 are coordinated so that the beam 40 sweeps over belt 12 at a frequency that matches the speed of the conveyor belt, for example, giving one sweep for every quarter inch of belt traveled. The photodetector 20 gives a start pulse for every sweep of the laser spot, the speed of such sweep being determined by the synchronized motor 38. A document 18 on the belt 12 will reflect the scan beams 40 to the photodetectors 42 which will sense the reflected light. The scan beams 40 received by the belt 12 will be absorbed by the same. Consequently, a pattern such as that shown in FIG. 8 will be received from the photodetectors by the logic controller 94. This pattern is digitalized by the converter 96 to place the signal in a form with which the logic controller 94 can more conveniently deal. The "a" dimension of the document 18, which may represent the width of the document, is indicated by the length of each pulse and the "b" dimension of the document, which may represent its length, is represented by the number of pulses, as represented in FIG. 8. Thus if a document 18 is an object on the belt 12 that is five inches wide and ten inches long, then the detector would recall a signal of twenty counts duration for each beam sweep. As the document 18 travels across the belt 18, this 20 counts will repeat 40 times. Thus a 20 count sweep repeated 40 times indicates object 5 inches by 10 inches (plus or minus 0.250 inches) traveling parallel to its long axis. With the small timing spot 20 being placed at the edge of the conveyor belt, a slot pulse 98 is generated before the measuring pulse occurs, see FIG. 8. Thus for a known number of counts, the detector will be extinguished as the beam travels from the reference spot to the scanned document 18. If a mail piece 18 is not properly registered and is too far away from the registration edge, the dead count will be longer. The controller can be programmed to provide a reject signal if the dead period exceeds a predetermined number of counts and the document would be placed into a selected receptacle 82 for recirculation.

If the number of pulses exceeds the number of counts in the pulse length, then the document is properly oriented. If the pulse length count is greater than the pulse count, then the letter is sitting on a short edge and thus must be routed through the ninety degree rotating station 45.

If the number of timing pulses that occur between mail pieces is below a certain predetermined number, then the successive mail pieces are lying too close together to begin free serving. If the number of timing pulses is, for example, less than four, than the indication is that the mail pieces are less than one inch and rejector deflector gate 80 may be operated to divert both documents into the receptacle 82 so that such documents may be placed back into the supply bin for reorientation on the conveyor belt.

If during a sequence of pulses the pulse length changes more than one count, then it can be assumed that either two documents of different widths are overlapped or a document 10'' is skewed and such documents will be directed to the receptacle 82 as previously described.

If the number of pulses exceeds the values for the maximum length or width, then the contoller 94 will divert the document 18 to one of the receptacles 84 by acting on the appropriate gate 78'. If, on the other hand, the number of pulses does not equal that required for the minimum length or width, then the controller will enable the appropriate gate 78'' to direct the document to the receptacle 86. When the controller receives an appropriate number of pulses to indicate a document 18 is a letter, it will direct the same to receptacle 88 and, when a flat is determined, the document will be directed to receptacle 92.

What is claimed is:

1. Apparatus for classifying a stream of mixed documents into size and orientation categories comprising:

a continuous belt;

means for depositing documents upon said belt;

laser means located above said belt for repeatedly sweeping a laser beam laterally across said belt;

sensing means located above said belt for sensing light reflected from documents disposed upon said belt;

logic means for determining the duration of light received by said sensor means during a sweep of said laser beam and for determining the number of sweeps in which light is sensed; and means for classifying mail pieces in response to said logic means determination.

2. The apparatus of claim 1 wherein said belt is inclined at an angle relative to the horizontal and a guide rail is located along the lower longitudinal edge of said belt.

3. The apparatus of claim 1 including a second sensing means for sensing the presence of a laser beam at a longitudinal location of said belt, said second sensing means being in electrical connection with said logic means.

4. The apparatus of claim 1 including means for rotating a document 90 degrees relative to the horizontal in response to the determination of said logic means.

5. The apparatus of claim 1 wherein said means for classifying mail pieces comprises a conveyor located downstream from said belt, a plurality of gates located within the path of said conveyor and in electrical connection with said logic means and a receptacle located adjacent each gate to receive documents therein upon enablement of its associated gate.

6. The apparatus of claim 5 wherein said laser means comprises a laser, a multi-faceted mirror spaced relative to said laser and means for rotating said mirror, the axis of said mirror extending longitudinally relative to said belt.

* * * * *